US007281482B1

(12) United States Patent
Beauchamp et al.

(10) Patent No.: US 7,281,482 B1
(45) Date of Patent: Oct. 16, 2007

(54) SIDE THRUSTER PERFORMANCE IMPROVEMENT WITH POWER OPTIMIZATION CONTROLLER

(75) Inventors: Charles H. Beauchamp, Seekonk, MA (US); William P. Krol, Jr., Portsmouth, RI (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/527,644

(22) Filed: Sep. 25, 2006

(51) Int. Cl.
*B63H 25/46* (2006.01)

(52) U.S. Cl. ..... 114/151; 440/1; 701/1

(58) Field of Classification Search ..... 114/151; 440/1, 53; 416/26, 87, 88, 89; 701/1
See application file for complete search history.

(56) References Cited

U.S. PATENT DOCUMENTS 4,018,181 A * 4/1977 Brix ..... 114/151
4,160,170 A 7/1979 Harner et al.
4,339,666 A 7/1982 Patrick et al.
4,584,486 A 4/1986 Quynn
4,747,359 A * 5/1988 Ueno ..... 114/151
6,009,822 A * 1/2000 Aron ..... 114/151
6,371,038 B1 4/2002 Beauchamp et al.
6,408,777 B1 6/2002 Beauchamp
7,121,219 B1 * 10/2006 Stallings ..... 114/151

* cited by examiner

*Primary Examiner*—Lars A. Olson
(74) *Attorney, Agent, or Firm*—James M. Kasischke; Michael P. Stanley; Jean-Paul A. Nasser

(57) ABSTRACT

A system and method of use for a marine vehicle to compensate for the effects of forward velocity of the vehicle and ambient currents of a water medium on lateral thrust from a lateral tunnel in the vehicle. A thruster in the tunnel has a variable pitch propeller rotated by a motor at a maintained constant speed to produce lateral thrust of flowing water through the tunnel. A power supply provides input power to the motor, and voltage and amp meters provide signals representative of the power. A computer generates pitch control signals from the representative signals, and a pitch actuator connected to the propeller and the computer is responsive to the pitch control signals to change the blade pitch of the propeller in order to maintain the lateral thrust at a predetermined level.

11 Claims, 2 Drawing Sheets

SIDE THRUSTER PERFORMANCE IMPROVEMENT WITH POWER OPTIMIZATION CONTROLLER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to marine vehicles and more particularly to marine vehicles having lateral thrusters.

(2) Description of the Prior Art

Surface and subsurface marine vehicles are expected to routinely provide a stable platform while maneuvering or station keeping during a wide variety of ambient conditions. Typically, data gathering and various military activities require precise maneuvering at very low speeds and hovering in currents. Marine vehicles use conventional rudders or other control surfaces to produce these maneuvering forces. However, a flow of ambient water over these control surfaces is required to produce an effective maneuvering force, and these forces vary with the square of the vehicle speed. Therefore, at low speed and during station keeping, conventional control surfaces become significantly less effective.

One way to avoid this limitation of control is to have one or more lateral tunnel thrusters in the bow or stern of marine vehicles to help respond to the low speed maneuvering requirements. The current art for lateral thrusters usually has a rotating propeller installed in a laterally traversing tunnel extending through the vehicle. The rotating propeller creates a pressure differential across the blades and drives a jet of water through the tunnel and out one side. The integrated pressure force on the blades is transferred as a force to the vehicle that acts in the opposite direction of the jet flow which, in turn, is used to maneuver the vehicle. For most applications, lateral tunnel thrusters are designed to be reversible so that the vehicle may be maneuvered in either port or starboard directions. As such, the blades can be rotated clockwise or counter clockwise to produce a jet in either direction to maneuver the host marine vehicle.

Unfortunately, the effectiveness of a tunnel thruster decreases with forward velocity of the vehicle. Often there is an intermediate vehicle speed at which neither the control surfaces nor the lateral thrusters produce effective maneuvering forces.

Early efforts to measure the effects of forward vehicle velocity on tunnel thruster performance have shown that as the forward velocity was increased to a speed of 3 knots, the effective side force (force perpendicular to the vehicle axes) from the tunnel thruster decreased to as low as 10 percent of the side force measured at zero the forward vehicle velocity. Thus, the current art tunnel thrusters quickly lose their maneuvering effectiveness as the forward vehicle velocity increases.

Experiments conducted to understand this phenomenon indicated that the forward velocity on the vehicle significantly increases fluid velocity through the tunnel for a fixed rotor (or propeller) speed. This results in the propeller blades operating off-design and unloading the blades, and the natural consequence of this condition results in less side thrust on the vehicle.

U.S. Pat. Nos. 6,371,038 (Beauchamp et al.) and 6,408,777 (Beauchamp) pertain to lateral tunnel thruster speed controls relying on sensing the velocity of fluid being axially driven through the lateral tunnel to vary angular speed of the propeller of the lateral thruster and to vary the pitch of the propeller of the lateral thruster, respectively.

Thus, a continuing need exists in the art for an effective control of lateral tunnel thrusters of marine vehicles at intermediate forward speeds that relies on monitoring and adjusting the levels of electrical power transmitted to motors rotating the propellers of the thrusters to assure more effective maneuvering of the vehicles.

SUMMARY OF THE INVENTION

It is therefore an object of the present invention to improve the control performance of lateral tunnel thrusters by using a power measuring device to directly monitor thrust; thereby, improving the maneuvering effectiveness of marine vehicles at intermediate speeds.

It is a further object of the present invention to provide a means for sensing power transmitted to a thruster motor for a lateral tunnel thruster of a marine vehicle in order to responsively change the lateral tunnel thrust of the thruster at different vehicle speeds.

It is a still further object of the present invention to provide a reliable means for controlling lateral thrust generated by a lateral thruster on a marine vehicle than fluid velocity measuring means conventionally relied upon.

It is a still further object of the present invention to provide a means for sensing power transmitted to thruster motors for a lateral tunnel thruster on a marine vehicle in order to responsively change the lateral thrust of the thruster in response to the forward velocity of the vehicle, ambient currents and arising conditions such as blockage in the lateral tunnel.

In order to attain the objects described, the present invention provides a system and method that compensates for the effects of forward velocity of a marine vehicle and ambient currents on lateral thrust from a lateral tunnel in the vehicle in order to improve maneuverability of the vehicle through a water medium. The marine vehicle has a lateral thruster including a variable pitch propeller mounted in the tunnel for producing a lateral thrust of flowing water through the tunnel, and an electric thruster motor is connected to the propeller for rotating the propeller to produce the lateral thrust. A power supply connects input power to the thruster motor, and voltage and amp meters provide signals representative of the input power to the thruster motor. A computer controller is appropriately programmed to generate pitch control signals from the representative signals, and a pitch actuator connected to the propeller and the computer controller is responsive to the pitch control signals to change the pitch of blades of the variable pitch propeller. The thruster motor rotates at a constant speed and the pitch of the blades is changed in response to the signals representative of motor input power to maintain the lateral thrust at the predetermined level irrespective of the effects of velocity through the water medium and ambient currents of the water medium.

The effects of the forward velocity through the water medium and water currents diminish the magnitude of the lateral thrust produced by the propeller. Accordingly, a feedback loop of the system increases the rate of the flowing water through the tunnel by changing the pitch of the blades of the propeller to maintain the lateral thrust at the predetermined level to compensate for the effects of forward velocity of the marine vehicle as it passes through the water medium and ambient currents of the water medium.

BRIEF DESCRIPTION OF THE DRAWINGS

Further objects, features and advantages of the present invention will become apparent upon reference to the following description of the preferred embodiment and to the drawings, wherein.

DESCRIPTION OF THE PREFERRED EMBODIMENT

Figure 1:
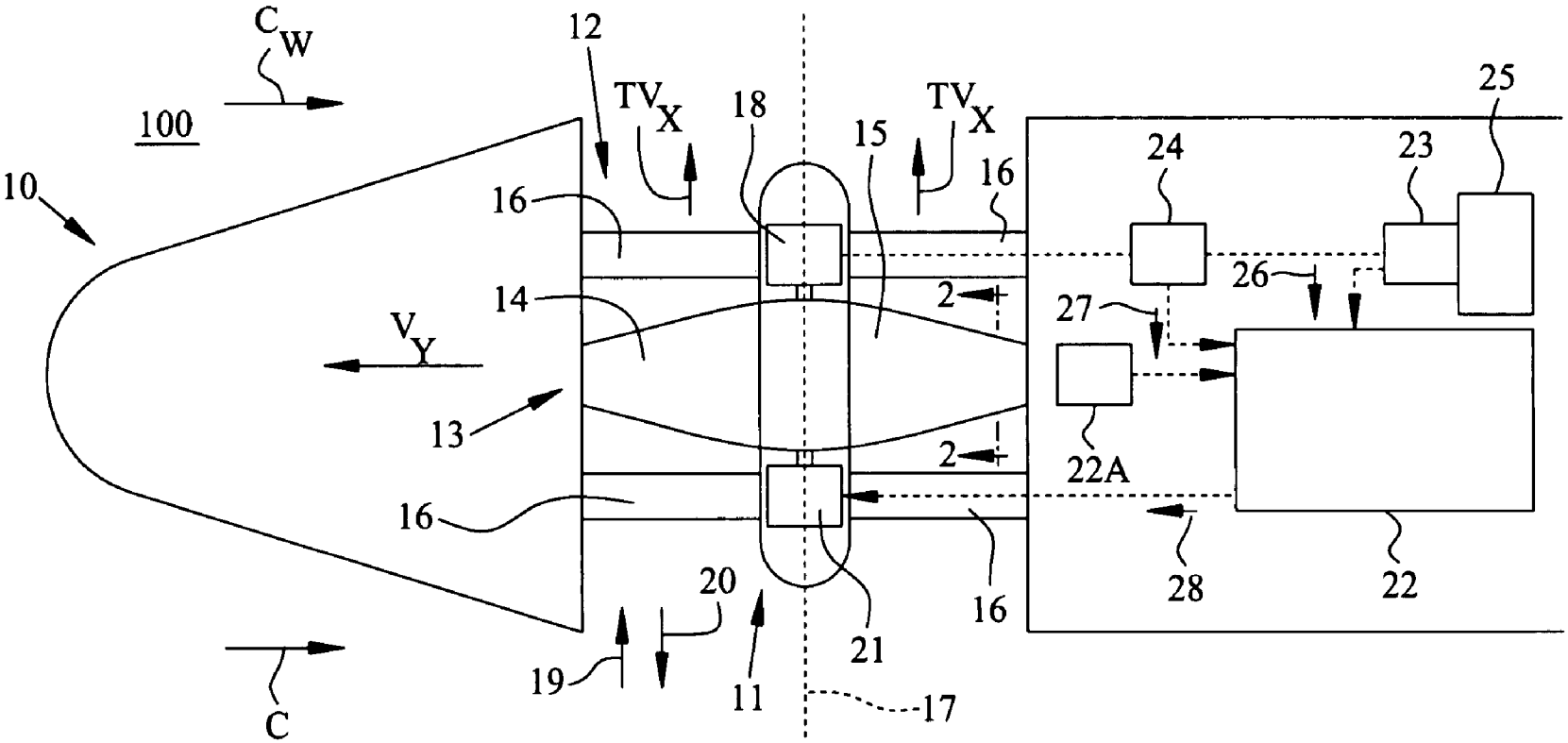
FIG. 1 schematically depicts a horizontal cross sectional of a marine vehicle with a lateral thruster with variable pitch blades controlled by the magnitude of electrical power input to an interconnected thruster motor.

Referring now to the drawings in detail wherein like numerals indicate like elements throughout the several views, FIG. 1 depicts a forward section of a marine vehicle 10 having a lateral thruster 11 in a tunnel 12 extending from one side to the other of the marine vehicle. The lateral thruster 11 is controlled in accordance with the present invention to mitigate the effects of forward velocity of the marine vehicle 10 (shown as arrow $V_V$) through an ambient water medium 100 that give the water medium an oppositely directed velocity (shown as arrow C) or ambient currents of the water medium (shown as arrow $C_W$) in water 100 on the magnitude of lateral thrust (T) produced by the lateral thruster. The lateral thrust can be generated to allow precise maneuvering of the marine vehicle 10 during transit and/or precise hovering of the vehicle in relatively strong ambient currents. The marine vehicle 10 can be any manned or unmanned, surface or subsurface craft and can have more than one tunnel 12 forward or aft (only a forward tunnel and a lateral thruster is shown for an understanding of the present invention).

The lateral thruster 11 has a propeller 13, mounted to extend across the tunnel 12, and the propeller 13 multiple radially extending blades (only blades 14 and 15 are shown). The propeller 13 is mounted in the tunnel 12 by several rigid and streamlined struts 16. Any number of other mounting arrangements known to those skilled in the art for the lateral thruster 11 can be selected so long as the propeller 13 is centered on a lateral axis 17 axially extending through the tunnel 12, and the tunnel is not overly obstructed. The propeller 13 is capable of selective bi-directional rotation about the axis 17.

A thruster motor 18 of the lateral thruster 11 is connected to the propeller 13 to rotate the propeller at a constant speed, although the propeller can be rotated at different selective speeds as described on below. In addition, the propeller 13 can be selectively rotated in either direction about the axis 17 to axially propel water in the tunnel 12 and selectively generate the lateral thrust (T) in either of opposite directions (as shown by arrows 19 or 20).

The lateral thruster 11 mitigates the effect of moving ambient water 100 (during forward velocity $V_V$ of marine vehicle 10) on the lateral thrust direction 19 or 20 produced by the propeller 13. This mitigating effect is accomplished by first measuring the input power delivered to the thruster motor 18, and then automatically controlling the pitch of blades of propeller 13 by an interconnected the propeller pitch actuator 21 of the lateral thruster 11 in order to compensate for the increased fluid velocity (shown by arrow $V_X$) in the tunnel 12. The measurement and automatically control occurs as the fluid velocity $V_X$ of the lateral thrust directions 19 or 20 in the tunnel 12 changes to maximize (or raise to a predetermined level) power delivered from the propeller 13 as lateral thrust. Thus, thruster efficiency of the thruster 11 is maintained and the performance of the thruster is improved.

Figure 2:
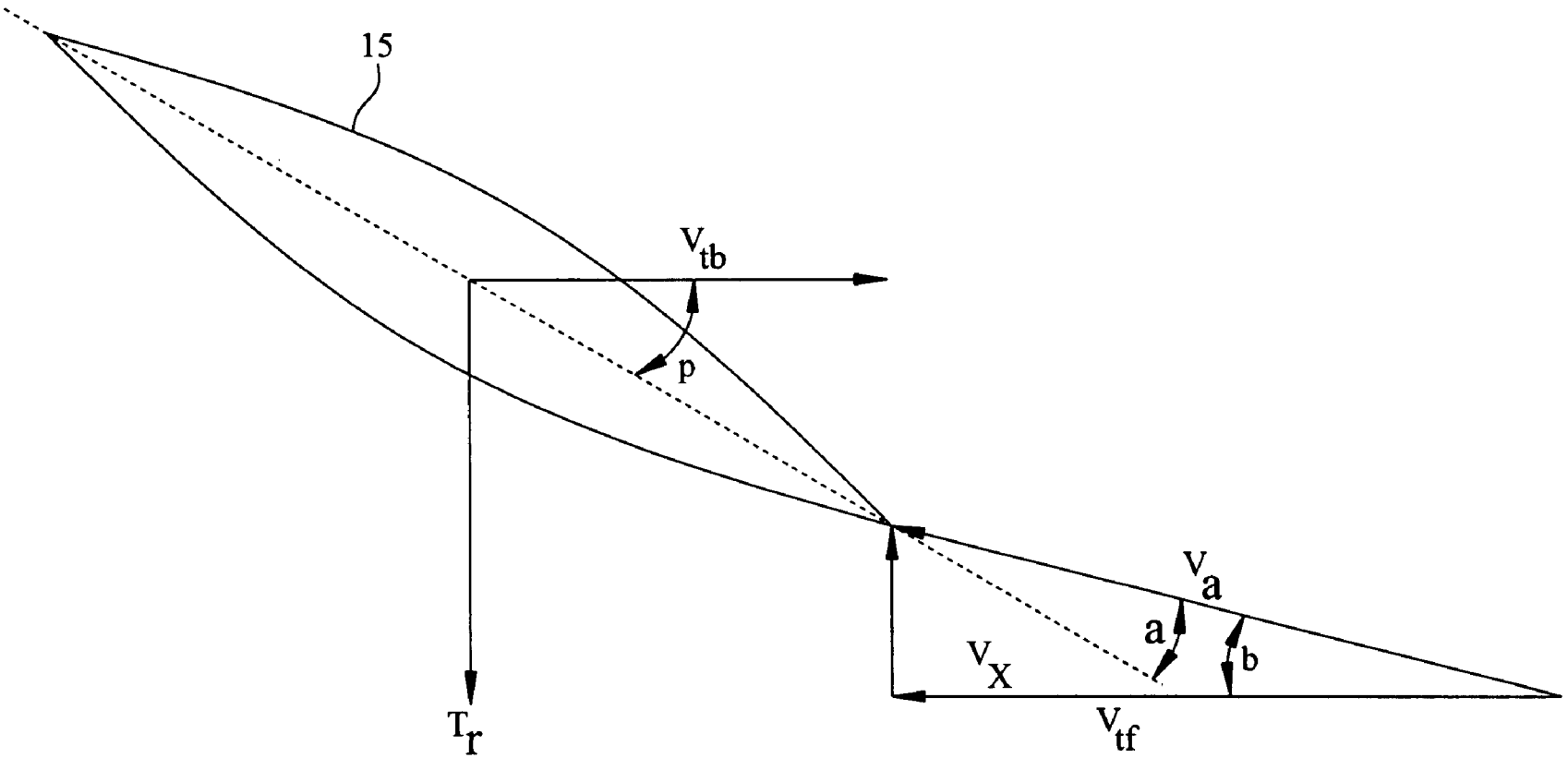
FIG. 2 is a schematic depicting the vector relationship of forces applicable to the present invention.

Referring also to FIG. 2, only the blade 15 of the propeller 13 is depicted in the cross-sectional view. It is understood that the effects of pitch and changing pitch created by the pitch actuator 21 on other blades is virtually identical as the propellers interact with the water medium 100 in the tunnel 12. The pitch actuator 21 that is used to vary pitch angle on the rotating blade could be any mechanism known to those ordinarily skilled in the art. These mechanisms have been used in numerous applications including marine vehicles and airplane propellers and helicopters. The interactions of variable pitch propellers and the electromechanical devices for selectively changing their pitch in response to appropriate control signals are well know in the art (for example, see U.S. Pat. No. 6,371,038). In addition, the pitch actuator 21 has the capability to operatively interface with a computer, such as a microcomputer controller 22 that has been appropriately programmed with programs and routines as schematically depicted at 22A to responsively accept commands from the microcomputer controller and initiate appropriate action for the pitch actuator 21.

The effect of the forward vehicle velocity ($V_V$) of the vehicle 10 on the thrust (T) of the lateral thruster 11 is mitigated by changing the blade pitch (p) to compensate for the increased fluid velocity ($V_X$) in the tunnel 12. This mitigating effect can be more completely understood by noting FIG. 2 which depicts the cross section of the propeller blade 15 in which the lateral thrust on the vehicle is the thrust force ($T_r$) of the blade sections integrated over the length of all the blades of the propeller 13. The thrust force ($T_r$) on any give cross section is strongly depended on the angle of attack (a) of the apparent fluid velocity ($V_a$) impinging on the leading edge of the blade.

The maximum thrust from each blade section will be obtained when that section is at an optimum angle of attack. Therefore, the maximum thrust on the vehicle 10 will be obtained when, in an integrated sense, the angle of attack is optimum on the blades.

The apparent velocity ($V_a$) is the resultant velocity from the vector sum of the axial fluid velocity ($V_X$) through the tunnel 12 and the tangential fluid velocity ($V_{tf}$) experienced by the blade due to the rotation of the blade. The tangential fluid velocity is equal in magnitude and opposite in direction to the tangential blade velocity ($V_{tb}$).

At a given cross section the magnitude is $$V_{tf}=V_{tb}=2\pi rN \tag{1}$$

where:

r=the local radius measured from the axis of rotation

N=the rotational speed in revolution per unit time.

The angle of the apparent velocity (b) is:

$$b=\arcsin(V_X/V_{tf})=\arcsin(V_X/2\pi rN) \tag{2}$$

The angle of attack is:

$$a=b-p$$

where: p=the blade pitch angle of each blade of propeller.

Therefore, with the propeller 13 rotating at a fixed speed (N), the angle of the apparent velocity (b) will change as the axial velocity changes. However, the optimum angle of attack (a) can be maintained by rotating the blade pitch (p) to compensate for changes in the apparent velocity (b).

The prior art referred to above relied on placing a flow sensor in a lateral tunnel to measure the velocity of impelled fluid in the tunnel and sent a representative signal as an input to a feedback control loop to adjust rotor pitch and maintain the optimum angle of attack. However, contrary to the approach of the prior art, the present invention seeks to maximize, or keep to a predetermined level, a lateral thrust of a vehicle that is generated by the lateral thruster 11. Consequently, the present invention measures lateral thrust more directly by measuring the input power to the thruster motor 18.

In accordance with the present invention the pitch-control microcomputer or computer controller 22 is connected to the pitch actuator 21 to command the pitch angle (p) of the blades of the propeller 13 and bases this command function on measured power input to the thruster motor 18. The voltage meter 23 and a current meter 24 are coupled to an electrical power supply 25 to continuously measure the voltage and current input of the power input to the thruster motor 18. Representative signals (shown as arrows 26 and 27) of the measured voltage and current are respectively connected from the meters 23 and 24 to the pitch-control microcomputer 22 to compute power fed to the thruster motor 18. Optionally, a single wattmeter might be used to provide such signals representative of power inputted to the thruster motor 18. Any commercially available method and/or devices may be used to measure input power (for example, by measuring current and voltage to the thruster motor 18 to compute input power). The power or current and voltage measuring devices must have provisions for providing the representative output signals 26 and 27 to the microcomputer 22. The computer 22 is programmed to send a pitch angle command signal (shown as arrow 28) to the pitch actuator 21 in response the measured power input to the thruster motor 18 as represented by the signals 26 and 27.

The signals 26 and 27 that represent power input to the thruster motor 18 provide a feedback to the microcomputer 22 to maintain efficiency (or continuing a level of lateral thrust) by the lateral thruster 11 to improve the performance of the lateral thruster by maintaining the level of thrust irrespective of the presence and/or changes of the axial fluid velocity ($V_X$). Continuation of thrust by the thruster 11 is accomplished by coupling the pitch angle control signals 28 to actuate the pitch actuator 21 to control the pitch of blades of the propeller 13 so that they maximize or maintain the constant predetermined level of lateral thrust.

A feedback loop 29 includes meters 23 and 24 generating the representative signals 26 and 27, the microcomputer 22 generating the control signals 28, the pitch actuator 21 connected to the propeller 13, and thruster motor 18. The feedback loop 29 controls the pitch of the blades of the propeller 13 based on the power connected to drive the thruster motor 18. For a given set thruster rotational speed, the microcomputer controller 22 would adjust pitch so as to maximize the required thruster power. Since power to the thruster motor 18 is proportional to torque, which in turn varies with thrust force ($T_r$) (i.e. an increase in torque leads to an increase in thrust), maximizing power for a given speed achieves the goal of maximizing thrust for that speed. Optionally, if thrust need not be maximized but rather is set at some other predetermined level, these parameters can be obtained and used in microcomputer 22 to create appropriate power levels for driving the thruster motor 18.

The optimum pitch angle of the blades of the propeller 13 as a function of axial fluid velocity $V_X$ can be predicted from historical propeller data or from computational analysis tools. However, the best method may be to conduct an experiment on a geometrically similar thruster configuration to determine the precise relationship between maximum thrust, fluid velocity, and pitch angle and these relationships could be entered into the programmed routines for the microcomputer controller 22. The control signals 28 responsive to the changing power input signals 26 and 27 would then initiate the pitch actuator 21 to make appropriate changes to the pitch of the blades of the propeller 13 in order to assure that the lateral thrust of lateral thruster 11 is at the proper level.

Thus, the present invention uses the power-measuring devices of the voltage and current meters 23 and 24 to directly monitor lateral thrust and to directly control modification of the pitch actuator 21 by the microcomputer 22 that incorporates a program including an algorithm responsive to historically gathered data for adjusting the blade pitch of the propeller 13 to maximize power input and thus maximize thrust. One advantage of this arrangement is improved thruster performance with forward vehicle velocity. Thus, the lateral thruster 11 can advantageously control the marine vehicle 10 at forward speeds greater than speeds possible with current thrusters known in the art. The present invention turns the angle of the blades of propeller 13 as the tunnel power or axial fluid velocity $V_X$ changes to maintain an optimum thrust on the marine vehicle 10.

Another advantage of the present invention as compared to the prior art is that the needs for measuring fluid velocity in the lateral tunnel and for measuring vehicle velocity are eliminated. The present invention provides a more direct method of assuring the optimum mean thrust over the entire blade span (all radii) of the propeller 13 as opposed to optimizing at a single nominal radius.

The inclusion of the power measuring meters 24 and 25 and an appropriately programmed microcomputer 22 allows the microcomputer not only to respond to the effect of forward velocity on performance of the lateral thruster and maintain optimum performance of the lateral thruster 11, but will also allow the microcomputer to respond to arising conditions that change the fluid velocity in the tunnel. For example, the tunnel 12 may be partially or totally blocked by a piece of debris, and such blockage may reduce the fluid velocity. A program 22A would allow the microcomputer 22 to accommodate this kind of an event and respond to change the pitch of blades of the propeller 13 to maintain optimum performance. The power measuring meters 24 and 25 and an appropriately programmed microcomputer 22 could also be part of a fault diagnosis and remediation system (for example, a drop in power of the motor may be an indication of a blockage). The microcomputer 22 could respond to this blockage by generating control signals 28 to change the pitch of blades of the propeller 13 in order to reverse the direction of flow from the lateral thruster 11 to dislodge or blow the blockage out of the tunnel 12.

While the invention as described refers to driving the lateral thruster 11 with the electric thruster motor 18, other motors such as a hydraulic motor or another rotary power device could be used as well. A hydraulic powered measuring device or other appropriate dynameter could be used as input to the microcomputer 22. The microcomputer 22 could be any of a number of different computer devices capable of being appropriately programmed by one skilled in the art to accommodate other prime movers and perform the functions described herein.

Although the present invention has been used to effect changes or steady-state levels in lateral thrust by varying pitch of the blades of the propeller 13, an alternative way to optimize lateral thrust with forward velocity is to adjust speed of the propeller 13. That is, the values of rotational speed (N) in Equation (2) can be adjusted to change the apparent angle velocity direction (b). Thus, in Equation (3)

with constant pitch (p), the optimum angle of attack (a) can be maintained by varying angle b.

Another alternative way to make changes or steady-state levels in the lateral thrust of lateral thruster 11 is to program the microcomputer controller 22 to be part of a feedback loop that is programmed with a commercially available control algorithm to set the speed of the thruster motor 18 based on input from the meters 24 and 25 and an appropriately programmed the microcomputer 22. The speed of thruster motor 18 can be changed to maximize or maintain levels of lateral thrust. A primary advantage of this alternative is that the alternative eliminates the need for a pitch adjusting mechanism such as the pitch actuator 21 and the variable pitch propeller 13 which can be costly, have maintenance problems, and/or induce additional friction in the system. In addition, any commercially available method and/or devices can be used to control the speed of the motor via appropriate command signals 28 from the microcomputer controller 22.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A system maneuverability of a marine vehicle through a water medium, said system comprising:

a lateral thruster positionable in a lateral maneuvering tunnel of the marine vehicle, said lateral thruster having a variable pitch propeller in which blades of said propeller are capable of producing a lateral thrust of flowing water therethrough;

a thruster motor mechanically connected to said propeller for rotating said propeller at a constant speed to produce the lateral thrust wherein said thruster motor is an electric motor producing the lateral thrust at a predetermined level;

a power supply electrically connected to and providing power to said thruster motor;

means connected to receive the input power for providing signals representative of the input power to said thruster motor;

means for generating pitch control signals from the signals representative of the input power; and means connected to said propeller and said generating means for changing a pitch of blades of the variable pitch propeller for maneuvering the marine vehicle and to maintain the lateral thrust at the predetermined level;

wherein said signal providing means includes a voltage meter and a current meter to produce the representative signals, said pitch control signal generating means includes a computer controller receiving the representative signals to generate the pitch control signals, and said pitch changing means includes a pitch actuator to change the pitch of said blades of said propeller.

2. The system of claim 1 wherein said voltage and current meters, said computer controller, said pitch actuator, and said thruster motor create a feedback loop for controlling the pitch of said blades of said propeller.

3. The system of claim 2 wherein control of the pitch of said blades by said feedback loop is based on the level of input power connected from said power supply to said thruster motor to maintain the level of the lateral thrust at the predetermined level.

4. The system of claim 3 wherein the lateral thrust at the predetermined level is capable of mitigating effects of forward velocity of the marine vehicle through the water medium and currents of the water medium.

5. The system of claim 4 wherein said feedback loop increases the rate of flowing water through the tunnel by changing the pitch of said blades of said propeller to maintain the lateral thrust at the predetermined level such that the effects of forward velocity of the marine vehicle through the water medium and the currents of the water medium are compensated for.

6. A method for maneuverability through a water medium for a marine vehicle, said method comprising the steps of:

positioning a lateral thruster with a variable pitch propeller in a lateral tunnel of the marine vehicle;

providing input power from a power supply to a thruster motor;

rotating the variable pitch propeller at a constant speed by a thruster motor to produce lateral thrust at a predetermined level within the lateral tunnel;

providing signals representative of the input power;

generating pitch control signals from the signals representative of said input power;

changing the pitch of blades of the variable pitch propeller in response to the pitch control signals and maintaining the lateral thrust at the predetermined level; and maneuvering the marine vehicle in response to the changing pitch of the variable pitch propeller;

wherein said step of providing signals representative of the input power utilizes a voltage meter and a current meter to produce the representative signals.

7. The method of claim 6 wherein said step of generating pitch control signals includes the step of:

providing a computer controller capable of receiving the representative signals to generate the pitch control signals.

8. The method of claim 7 wherein said step of changing the pitch of the variable pitch propeller includes the step of:

providing a pitch actuator to change the pitch of the blades of the propeller.

9. The method of claim 8 further including the step of:

creating a feedback loop with the voltage and current meters, the computer controller, the pitch actuator connected to the propeller, and the thruster motor with the feedback loop for controlling the pitch of said blades of the propeller.

10. The method of claim 9 further comprising the step of:

controlling the pitch of the blades by the feedback loop on the level based of input power from the power supply to the thruster motor such that the level of the lateral thrust is maintained at the predetermined level.

11. The method of claim 10 further comprising the steps of:

increasing a rate of flowing water through the tunnel by the feedback loop by said step of changing the pitch of the blades of the propeller to maintain the lateral thrust at the predetermined level; and compensating for the effects of forward velocity of the marine vehicle through the water medium and currents of the water medium.

* * * * *